United States Patent [19]

Unsworth et al.

[11] 4,401,621

[45] Aug. 30, 1983

[54] MAGNESIUM ALLOYS

[75] Inventors: William Unsworth, Wigan; John F. King, Greenmount; Stephen L. Bradshaw, Ladybridge, all of England

[73] Assignee: Magnesium Elektron Limited, Great Britain

[21] Appl. No.: 361,645

[22] Filed: Mar. 25, 1982

[30] Foreign Application Priority Data

Mar. 25, 1981 [GB] United Kingdom ..... 8109364

[51] Int. Cl.[3] ..... C22C 23/06

[52] U.S. Cl. ..... 420/403; 420/405; 420/406; 148/420

[58] Field of Search ..... 75/168 J; 148/32.5, 148/420; 420/403, 405, 406

[56] References Cited

U.S. PATENT DOCUMENTS

| | | | |
|---|---|---|---|
| 4,116,731 | 9/1978 | Tikhova et al. | 148/161 |
| 4,149,882 | 4/1979 | Unsworth et al. | 420/403 |
| 4,168,161 | 9/1979 | Unsworth et al. | 420/403 |
| 4,173,469 | 1/1979 | Unsworth et al. | 420/403 |
| 4,194,908 | 3/1980 | Unsworth et al. | 420/403 |
| 4,239,535 | 12/1980 | King et al. | 148/161 |

FOREIGN PATENT DOCUMENTS

| | | | |
|---|---|---|---|
| 1378281 | 12/1974 | United Kingdom | 75/168 J |

*Primary Examiner*—M. J. Andrews

*Attorney, Agent, or Firm*—Karl W. Flocks; Sheridan Neimark

[57] ABSTRACT

Magnesium alloys for castings having good tensile properties at both ambient and high temperatures and good resistance to creep contain 1.5–10% of yttrium or an yttrium/heavy rare earths mixture and 1–6% of neodymium or a neodymium/lanthanum/praseodymium mixture. The alloys may be heat treated to improve their properties.

17 Claims, No Drawings

MAGNESIUM ALLOYS

This invention relates to magnesium alloys suitable for use in castings containing yttrium and neodymium.

Cast magnesium alloys are used in aerospace applications where good mechanical properties at both ambient and elevated temperatures are required. For example magnesium alloy components in an aero engine or helicopter rotor drive gearbox may have to retain their strength and also resist creep at a temperature of 200° C. or above. Existing magnesium alloys for such uses contain appreciable amounts, typically about 1.5–2.5% by weight, of silver. Silver is an expensive component and its price is subject to wild fluctuations for reasons associated with its use as a currency. Magnesium alloys containing silver have a lower resistance to corrosion than silver free magnesium alloys.

The present invention is intended to provide magnesium alloys capable of giving castings which have good tensile properties at both ambient and elevated temperatures, and are resistant to creep while having an adequate ductility, but which do not contain large amounts of silver.

According to one aspect of the invention, there is provided a magnesium alloy containing, apart from normal impurities, (a) from 1.5 to 10% by weight of an yttrium component consisting of at least 60% by weight of yttrium and the balance, if any, of heavy rare earth metals, and (b) from 1 to 6% by weight of a neodymium component consisting of at least 60% by weight of neodymium, not more than 25% by weight of lanthanum and substantially all the balance, if any, of prasecdymium, the remainder of the alloy consisting of magnesium. The alloy may contain zirconium as a grain refiner, for example in an amount up to 1% and typically around 0.4%.

It should be noted that yttrium is not considered herein as a rare earth metal as it is not a member of the lanthanide series.

The yttrium component any consist of pure yttrium but as this is an expensive material it is preferred to use a mixture containing at least 60% yttrium and the remainder heavy rare earth metals. A "heavy rare earth metal" is a rare earth metal having an atomic number of 62 or above. The yttrium content of the yttrium component may be at least 62% and is preferably at least 75%.

The neodymium component may consist of 100% neodymium but as purification of neodymium to this level is grossly expensive it is preferred to use a mixture containing at least 60% of neodymium and up to 25% by weight of lanthanum with any balance being praseodymium: the mixture thus contains substantially no cerium.

It will be understood that when the yttrium and/or neodymium components contain rare earth metal mixtures as stated above identical alloys are obtained by adding the yttrium and/or the neodymium to the alloy melt as pure metals and adding rare earth metals separately, or by adding the yttrium and neodymium as mixtures containing the rare earth metals. Alloys made by both methods are to be considered as within the scope of this invention, the terms "yttrium component" and "neodymium component" relating to the composition of the alloy and not to the manner in which the constituents of the alloy are added to the melt. However, in practice the yttrium would normally be added to the alloy together with the heavy rare earth metals (if any) and the neodymium would be added with the above-specified rare earth metals of the neodymium component.

The content of yttrium component may be from 1.5 to 9% and the neodymium component may contain not more than 10% of lanthanum.

In an embodiment of the invention the total content of yttrium component and neodymium component is from 4 to 14%.

Alloys within the invention are capable of giving good tensile properties over a wide range of temperatures and high resistance to creep while possessing adequate ductility. It has been found that within the composition range specified above particular contents of yttrium and neodymium components are capable of producing specific desirable combinations of properties. Thus, according to one embodiment of the invention the content of yttrium component is 2.5–7%, that of neodymium component is 1.5–4% and the total content of yttrium component and neodymium component is 6–8.5%. Alloys within this range give high tensile properties both at mbient and elevated temperatures at least equivalent to those obtained from currently available silver-containing high strength magnesium alloys.

According to another embodiment the yttrium component content is from 3.5 to 9% and the neodymium component content 2.5 to 5%, the total yttrium and neodymium components being from 7.5 to 11.5%. Alloys within this range give very good mechanical properties (including resistance to creep) at elevated temperatures up to 300° C. or higher, accompanied by a lower ductility compared with other alloys within the invention. Especially good properties are obtained in the absence of zirconium in the alloys of this embodiment.

According to yet another embodiment the yttrium component content is from 3.5 to 8%, a neodymium component 2 to 3.5% and the total of yttrium and neodymium components 7–10%. Alloys within this range have favourable mechanical properties at ambient and elevated temperatures while retaining satisfactory ductility, making them highly suitable for engineering applications.

Other elements which may be incorporated in the alloy are up to 1% of cadmium or not more than 1% of silver or up to 0.15% of copper. One or more of the following constituents may also be present in amounts consistent with their solubilities:

Thorium—0–1%
Lithium—0–6%
Gallium—0–2%
Indium—0–2%
Thallium—0–5%
Lead—0–1%
Bismuth—0–1%
Manganese—0–2%

Zinc should be substantially absent as zinc combines with yttrium to form a stable intermetallic compound with yttrium, nullifying the effect of the yttrium in the compound.

The alloys of the invention may be made by conventional methods. As the metals of the yttrium component generally have relatively high melting points they are preferably added to the melt in the form of a hardener alloy consisting of magnesium and a high proportion of the metals to be added. The neodymium component may also be added in the form of a magnesium hardener alloy. When melting is carried out by the techniques normally used for magnesium alloys, i.e. under a protective flux or a protective atmosphere such as $CO_2/SF_6$ or air/$SF_6$ undesirable losses of yttrium, by reaction with the flux or preferential oxidation, may occur. It is therefore preferred to carry out melting under an appropriate inert atmosphere, such as argon.

The alloys of the invention may be cast by conventional methods to form cast articles. The castings generally require heat treatment to give optimum mechanical properties. One type of heat treatment comprises solution heat treatment, preferably at the highest practicable temperature (normally about 20° C. below the solidus temperature of the alloy) followed by quenching and ageing at an elevated temperature. An example of a suitable heat treatment comprises holding the casting at 525° C. for 8 hours followed by rapid quenching in a suitable medium such as water or an aqueous solution of a quench moderating agent such as UCON, and then ageing at about 200° C. for 20 hours. However it has been found that ageing at elevated temperature for a longer period, for example up to 144 hours, can give increased tensile properties for at least some of the alloys of the invention.

It has also been found that simpler heat treatments can improve the properties of the as-cast alloy. The cast alloy may be aged, for example at 200° C. for 20 hours, without solution heat treatment or quenching and the strength of the alloy is considerably increased and a good level of ductility is achieved.

Alloys according to the present invention, together with other alloys given for comparison, will be described in the following Examples.

EXAMPLES

Alloys of magnesium having the added elements given in Table 1 were cast into test specimens and the specimens were heat treated as shown in Table 1. The Nd component, indicated in the tables simply as "Nd" was a rare earth mixture containing at least 60% by weight of neodymium, substantially no cerium, up to 10% lanthanum and the remainder praseodymium. The yttrium component indicated as "Y" was pure yttrium unless otherwise stated. The yield stress, ultimate tensile stress and elongation were measured at room temperature by standard methods and the results are given in Table 1. These properties were also measured at 250° C. for some of the alloys and the results are given in Table 2. The results for known magnesium alloys QE 22 and QH 21, which contain 2.5% silver but no yttrium, are given for comparison.

The mechanical properties of some alloys were also measured at temperatures above 250° C. and the results are shown in Table 3. Room and high temperature results for a further alloy, No. 16, are shown in Table 4 in which "HRE" refers to heavy rare earthf metals: in this alloy the yttrium and heavy rare earth metals were added as a mixture.

Other alloys were cast, heat treated and tested in the same way at 20°, 250°, 300°, 325° and 350° C. and the results are shown in Table 5. Comparative results are given for QE 22, QH 21 and also for EQ 21 (a magnesium alloy containing 2% of neodymium component and 1.5% silver) and RR 350 (an aluminium alloy having a high resistance to creep).

Alloy specimens were cast and heat-treated in the same way and subjected to a standard creep test at 300° C. using a stress of 23 N/mm$^2$. The time to reach 0.2% creep strain was measured and the results are are shown in Table 6, with comparative values for RR 350 and ZT 1 (a magnesium alloy containing zinc and thorium but no rare earth metals which is known to have a high resistance to creep).

The following conclusions may be drawn from these results.

1. Alloys according to the invention containing zirconium as a grain refiner gave room temperature yield stress comparable to those of QE 22 and QH 21 (the specified minimum room temperature yield stress for QE 22 is 175 N/mm$^2$) and the room temperature ultimate tensile strengths were much higher than for QE 22 and QH 21.

2. The alloys according to the invention gave much better mechanical properties at high temperatures than QE 22 and QH 21, especially at higher yttrium contents. The mechanical properties of QE 22 and QH 21 decline rapidly at temperatures above 250° C. whereas those of the alloys of the invention are maintained to a very considerable degree.

3. Pure yttrium may be replaced by a mixture of yttrium and heavy rare earth metals, containing at least 60% and preferably at least 75% of yttrium giving a large reduction in cost, without loss of mechanical properties.

4. The results for alloys 1–3 show that zirconium may be omitted and good results are still obtained. It is believed that the yttrium itself acts as a grain refiner in the alloy.

5. Especially good tensile properties at both ambient and elevated temperatures are obtained with a content of yttrium component from 2.5 to 7%, neodymium component from 1.5 to 4% and a total of yttrium and neodymium components from 6 to 8.5%.

6. Very good mechanical properties, including creep resistance, at temperatures of 300° C. and above are obtained with a content of yttrium component from 3.5 to 9%, a neodymium component from 2.5 to 5% and total of yttrium and neodymium component from 7.5 to 11.5%, especially when zirconium is absent. However the ductility of these alloys tend to be low.

7. The following range of compositions among the alloys of the invention give a compromise between good ductility and high mechanical properties at room and elevated temperatures which is favourable for many engineering applications: yttrium component 3.5–8%, neodymium component 2–3.5% and total of yttrium and neodymium components 7–10%.

By way of comparison, a known magnesium alloy RZ5 which contains rare earth metals and zinc but no yttrium has much lower tensile properties. For example the specified minimum yield stress for RZ5 at room temperature is 135 N/mm$^2$ and the alloys of the present invention have considerably higher yield stresses.

Other alloys were cast, heat treated and tested in the same way at 20°, 250°, 300°, 325° and 350° C. and the results are shown in Table 5. Comparative results are given for QE 22, QH 21 and also for EQ 21 (a magnesium alloy containing 2% of neodymium component and 1.5% silver) and RR 350 (an aluminium alloy having a high resistance to creep).

Alloy specimens were cast and heat-treated in the same way and subjected to a standard creep test at 300° C. using a stress of 23 N/mm$^2$. The time to reach 0.2% creep strain was measured and the results are shown in Table 6, with comparative values for RR 350 and ZT 1

(a magnesium alloy containing zinc and thorium but no rare earth metals which is known to have a high resistance to creep).

In a further series of tests the alloys shown in Table 7 were cast, heat treated in the manner shown in the Table and tested at room temperature. It will be noted that after solution heat treatment and quenching the tensile properties are improved by prolonged ageing at elevated temperature, at least up to 144 hours at 200° C. Also, ageing at elevated temperature of the as-cast alloy without solution heat treatment and quenching gave attractive mechanical properties.

In order to investigate casting behaviour an alloy according to the invention was subjected to a fluidity spiral casting test and the result is shown in Table 8 with comparative results for QE 22, ZE 63 (a magnesium alloy containing zinc and rare earth metals) and AZ 91 (a magnesium alloy containing magnesium and zinc). The alloy according to the invention gave a favourable result in comparison with the other alloys.

In order to test microporosity on casting an alloy according to the invention was subjected to a standard Spitaler box bottom run casting test in which a sample is cast and radiographed. The result is shown in Table 9 with the result for QE 22 for comparison. Result AA is the area affected by microporosity and MR is the maximum ASTM rating for microporosity in the area affected. The result for the alloy according to the invention is superior to that for QE 22, which itself is an alloy accepted as having good casting behaviour for use in complex aerospace components.

Alloys according to the invention were tested for corrosion by immersion for 28 days in 3% sodium chloride solution saturated with magnesium hydroxide ("immersion" test) and by a Royal Aircraft Establishment test in which they were subjected to salt spray and atmospheric exposure ("RAE" test). The results are shown in Table 10 with corresponding results for alloy QE 22 and RZ5. The RZ5 had been heat treated by simple ageing at elevated temperature, the others had been aged after solution heat treatment and quenching. The results shown in Table 10 record the amount of the alloy corroded away per unit area and unit time, taking RZ5 as unity. It will be seen that the corrosion rate for alloys according to the invention is markedly less than for RZ5 and QE 22.

TABLE 1

| ALLOY NO. | DESIGNATION | ANALYSIS % Y | Nd | Zr | Cd | Cu | Ag | HEAT TREATMENT SOLUTION | QUENCH | AGE | TEN. PROPS. (N/mm²) YS | UTS | E % |
|---|---|---|---|---|---|---|---|---|---|---|---|---|---|
| 1 | YED 5,2,½ | 4.8 | 2.1 | <0.1 | 0.53 | — | — | 8 hrs 535° C. | H.W.Q. | 20 hrs 200° C. | 156 | 251 | 3 |
| 2 | YED 5,2,2 | 4.8 | 2.1 | " | 1.25 | — | — | " | " | " | 159 | 231 | 2 |
| 3 | YED 5,3,½ | 5.2 | 3.3 | " | 0.41 | — | — | 8 hrs 525° C. | 30% UCON | " | 185 | 248 | 2 |
| 4 | YEK 4,2,1 | 4.3 | 2.0 | 0.46 | — | — | — | 8 hrs 535° C. | H.W.Q. | " | 163 | 308 | 8 |
| 5 | YEK 4,4,1 | 3.7 | 3.7 | 0.38 | — | — | — | " | " | " | 188 | 302 | 3 |
| 6 | YEK 3,5,1 | 3.2 | 5.0 | 0.43 | 0.02 | — | — | " | " | " | 193 | 299 | 2 |
| 7 | YEKD 2,4,1,½ | 1.8 | 3.9 | 0.41 | 0.58 | — | — | " | " | " | 171 | 279 | 3 |
| 8 | YEKD 4,2,1,½ | 3.8 | 1.9 | 0.38 | 0.49 | — | — | " | " | " | 158 | 282 | 5 |
| 9 | YEKD 4,3,1,½ | 3.9 | 2.9 | 0.43 | 0.55 | — | — | " | " | " | 181 | 312 | 5 |
| 10 | YEKD 3,4,1,½ | 3.4 | 4.0 | 0.38 | 0.40 | — | — | " | " | " | 185 | 279 | 1½ |
| 11 | YEKD 6,3,1,½ | 5.5 | 3.5 | 0.38 | 0.44 | — | — | 8 hrs 525° C. | 30% UCON | " | 215 | 306 | ¾ |
| 12 | YEKC 4,2,1 (0.1) | 4.2 | 2.0 | 0.40 | <0.1 | (0.1) | — | 16 hrs 475° C. | H.W.Q. | " | 179 | 286 | 7 |
| 13 | YEKC 3,4,1 (0.1) | 3.4 | 3.9 | 0.42 | " | (0.1) | — | " | " | " | 171 | 249 | 1 |
| 14 | YEKQ 4,3,1,½ | 4.2 | 2.6 | 0.38 | " | — | (0.5) | 8 hrs 535° C. | " | " | 173 | 328 | 7 |
| | QE 22 | — | 2.0 | 0.6 | — | — | 2.5 | 8 hrs 525° C. | " | " | 205 | 266 | 4 |
| | QH 21 | — | 1 | 0.6 | — | 1 (Thorium) | 2.5 | " | " | " | 210 | 270 | 4 |

TABLE 2

| ALLOY NO. | DESIGNATION | ANALYSIS % Y | Nd | Zr | Cd | Cu | Ag | Th | SOLUTION TREATMENT TEMP/TIME | TENSILE PROPERTIES AT 250° C. Y.S. (N/mm²) | UTS (N/mm²) | E % |
|---|---|---|---|---|---|---|---|---|---|---|---|---|
| — | QE 22 | — | (2) | (0.6) | — | — | (2½) | — | 8 hr 525° C. | 122 | 160 | 30 |
| — | QH 21 | — | (1) | (0.6) | — | — | (2½) | (1) | 8 hr 525° C. | 167 | 185 | 16 |
| 3 | YED 5,3,½ | 5.2 | 3.3 | <0.1 | 0.41 | — | — | — | 8 hr 525° C. | 167 | 266 | 8 |
| 5 | YEK 4,4,1 | 3.7 | 3.7 | 0.38 | — | — | — | — | 8 hr 535° C. | 162 | 265 | 11 |
| 6 | YEK 3,5,1 | 3.2 | 5.0 | 0.43 | 0.02 | — | — | — | " | 178 | 266 | 5 |
| 7 | YEKD 2,4,1,½ | 1.8 | 3.9 | 0.41 | 0.58 | — | — | — | " | 155 | 230 | 6 |
| 9 | YEKD 4,3,1,½ | 3.9 | 2.9 | 0.43 | 0.55 | — | — | — | " | 158 | 256 | 12 |
| 10 | YEKD 3,4,1,½ | 3.4 | 4.0 | 0.38 | 0.40 | — | — | — | " | 173 | 265 | 6½ |
| 11 | YEKD 6,3,1,½ | 5.5 | 3.5 | 0.38 | 0.44 | — | — | — | " | 193 | 287 | 2 |
| 12 | YEKC 4,2,1(0.1) | 4.2 | 2.0 | 0.40 | <0.1 | (0.1) | — | — | 16 hr 475° C. | 142 | 240 | 17.5 |
| 13 | YEKC 3,4,1(0.1) | 3.4 | 3.9 | 0.42 | <0.1 | (0.1) | — | — | 8 hr 475° C. | 144 | 210 | 5 |
| 14 | YEKQ 4,3,1,½ | 4.2 | 2.6 | 0.38 | <0.1 | — | (0.5) | — | 8 hr 535° C. | 152 | 254 | 17 |

Analyses in brackets are nominal only.

TABLE 3

| ALLOY NO. | DESIGNATION | ANALYSIS % Y | Nd | Zr | Cd | MECHANICAL PROPERTIES AT TEMPERATURE STATED TEMP °C. | Y.S. (N/mm²) | UTS (N/mm²) | E % | 0.2/100 |
|---|---|---|---|---|---|---|---|---|---|---|
| — | QE 22 | 2.5% Ag-2.0% Nd-0.6% Zr | | | | 20 | 205 | 266 | 4 | — |
| | | | | | | 250 | 122 | 160 | 30 | 32 |
| | | | | | | 300 | 70 | 80 | 62 | — |
| — | QH 21 | 2.5% Ag-1% Nd-1% Th-0.6% Zr | | | | 20 | 210 | 270 | 4 | — |

TABLE 3-continued

| ALLOY NO. | DESIGNATION | ANALYSIS % Y | Nd | Zr | Cd | MECHANICAL PROPERTIES AT TEMPERATURE STATED TEMP °C. | Y.S. (N/mm²) | UTS (N/mm²) | E % | 0.2/100 |
|---|---|---|---|---|---|---|---|---|---|---|
| | | | | | | 250 | 167 | 185 | 16 | 38 |
| | | | | | | 300 | 120 | 131 | 19 | |
| 15 | YEKD 931½ | | | | | 20 | 235 | 295 | ½ | |
| | | 8.1 | 3.1 | 0.51 | 0.6 | 250 | 208 | 320 | 2 | 42 |
| | | | | | | 300 | 176 | 242 | 3½ | 23 |
| | | | | | | 325 | 161 | 204 | 3 | — |
| | | | | | | 350 | 131 | 169 | 8½ | — |
| 11 | YEKD 631½ | 5.5 | 3.5 | 0.38 | 0.44 | 20 | 215 | 306 | ¾ | |
| | | | | | | 250 | 193 | 287 | 2 | |
| | | | | | | 300 | 176 | 218 | 13 | |
| | | | | | | 325 | 156 | 182 | 13 | |

TABLE 4

| ALLOY NO. | DESIGNATION | ANALYSIS % Y | Nd | HRE | Zr | Cd | TENSILE PROP. AT TEMP. STATED Temp °C. | YS (N/mm²) | UTS (N/mm²) | E % |
|---|---|---|---|---|---|---|---|---|---|---|
| 16 | YEKD 5,3,1,½(62) | 2.8 | 3.6 | 1.7 | 0.47 | 0.5 | 20 | 183 | 254 | 1½ |
| | | | | | | | 250 | 154 | 238 | 4 |
| 10 | YEKD 3,4,1,½ | 3.4 | 4.0 | — | 0.38 | 0.40 | 20 | 185 | 279 | 1½ |
| | | | | | | | 250 | 173 | 265 | 6½ |
| | QE 22 | 2.5% Ag-.0% Nd-0.6% Zr | | | | | 20 | 205 | 266 | 4 |
| | | | | | | | 250 | 122 | 160 | 30 |

TABLE 5

| DESIGNATION | ANALYSIS % Y | Nd | Zr | Cd | Cu | HRE | HEAT TREATMENT Sol$^n$ | Quench | Age | Tensile Properties (N/mm²) at Temp. Stated 20° C. YS | UTS | E % | 250°C. YS | UTS | E % |
|---|---|---|---|---|---|---|---|---|---|---|---|---|---|---|---|
| YE 5½,3 | 5.5 | 2.8 | — | — | — | — | 8 h 525° C. | UCON | 20 h 200° C. | 194 | 243 | ½ | 153 | 250 | 9½ |
| YE 5½,3 | 5.4 | 3.0 | — | — | — | — | 8 h 535° C. | HWQ | " | 190 | 282 | 1 | — | — | — |
| YED 5,2,½ | 4.8 | 2.1 | — | 0.5 | — | — | 8 h 535° C. | HWQ | " | 156 | 251 | 3 | | | |
| YED 5,3½,½ | 5.2 | 3.3 | — | 0.4 | — | — | 8 h 525° C. | UCON | " | 185 | 248 | 2 | 167 | 266 | 8 |
| YED 5½,3,½ | 5.5 | 2.9 | — | 0.5 | — | — | " | UCON | " | 194 | 244 | ¾ | 154 | 257 | 9 |
| YEK 2½,3½,1 | 2.4 | 3.6 | 0.7 | — | — | — | 8 h 535° C. | UCON | " | 153 | 295 | 3½ | 143 | 243 | 10 |
| YEK 2½,2,1 | 2.5 | 1.8 | 0.7 | — | — | — | " | UCON | " | 135 | 295 | 9½ | | | |
| YEK 3,5,1 | 3.2 | 5.0 | 0.4 | — | — | — | " | HWQ | " | 193 | 299 | 2 | 178 | 266 | 5 |
| YEK 3½,3½,1 | 3.7 | 3.7 | 0.4 | — | — | — | " | HWQ | " | 188 | 302 | 3 | 162 | 265 | 11 |
| YEK 4,1½,1 | 3.8 | 1.7 | 0.6 | — | — | — | " | UCON | " | 154 | 309 | 10 | 121 | 215 | 19½ |
| YEK 4,3,1 | 3.8 | 2.8 | 0.6 | — | — | — | " | UCON | " | 191 | 330 | 4 | 154 | 252 | 9 |
| YEK 4,1½,1 | 3.9 | 1.7 | 0.4 | — | — | — | 8 h 525° C. | UCON | " | 159 | 301 | 8 | | | |
| YEK 4½,2,1 | 4.3 | 2.0 | 0.5 | — | — | — | 8 h 535° C. | HWQ | " | 163 | 308 | 8 | | | |
| YEK 5,2,1 | 5.0 | 1.8 | 0.6 | — | — | — | 8 h 525° C. | UCON | " | 180 | 319 | 8 | 152 | 234 | 17½ |
| YEK 5½,3,1 | 5.5 | 3.0 | 0.4 | — | — | — | 8 h 535° C. | HWQ | " | 212 | 335 | 2 | — | — | — |
| YEK 6½,1½,1 | 6.3 | 1.5 | 0.6 | — | — | — | 8 h 525° C. | UCON | " | 195 | 303 | 3 | 151 | 234 | 9½ |
| YEKD 2,4,1,½ | 1.8 | 3.9 | 0.4 | 0.6 | — | — | 8 h 535° C. | HWQ | " | 171 | 279 | 3 | 155 | 230 | 6 |
| YEKD 3½,2,1,½ | 3.4 | 1.9 | 0.6 | 0.5 | — | — | " | UCON | " | 159 | 288 | 6 | | | |
| YEKD 3½,4,1,½ | 3.4 | 4.0 | 0.4 | 0.4 | — | — | " | HWQ | " | 185 | 279 | 1½ | 173 | 265 | 6½ |
| YEKD 4,2,1,½ | 3.8 | 1.9 | 0.4 | 0.5 | — | — | " | HWQ | " | 158 | 282 | 5 | | | |
| YEKD 4,3,1,½ | 3.9 | 2.9 | 0.4 | 0.6 | — | — | " | HWQ | " | 181 | 312 | 5 | 158 | 256 | 12 |
| YEKD 5¼,3½,1,½ | 5.5 | 3.5 | 0.4 | 0.4 | — | — | " | UCON | " | 215 | 306 | ¾ | 193 | 287 | 2 |
| YEKD 6,1½,1,½ | 6.0 | 1.5 | 0.6 | 0.5 | — | — | 8 h 525° C. | UCON | " | 188 | 322 | 5 | 151 | 236 | 6 |
| YEKD 8,3,1,½ | 8.1 | 3.1 | 0.6 | 0.5 | — | — | " | UCON | " | 235 | 295 | ½ | 208 | 320 | 2 |
| YEKC 3½,4,1,0 | 3.4 | 3.9 | 0.4 | — | (0.1) | — | 16 h 475° C. | HWQ | " | 171 | 249 | 1 | 144 | 210 | 5 |
| YEKC 4,2,1,0 | 4.2 | 2.0 | 0.4 | — | (0.1) | — | " | HWQ | " | 179 | 286 | 7 | 142 | 240 | 17.5 |
| YEKC 4½,3,1,0 | 4.6 | 2.9 | 0.5 | — | (0.1) | — | 8 h 500° C. | UCON | " | 202 | 317 | 3½ | 158 | 239 | 4 |
| Y(62) K 8,1 | 5.0 | — | 0.5 | — | — | 3.0 | 8 h 525° C. | UCON | " | 165 | 260 | 2 | 136 | 216 | 14 |
| Y(62) EK 2½,2,1 | 1.6 | 1.9 | 0.6 | — | — | (1.0) | 8 h 535° C. | UCON | " | 139 | 269 | 5 | | | |
| Y(62) EK 3½,2,1 | 2.2 | 1.9 | 0.5 | — | — | (1.4) | 8 h 525° C. | UCON | " | 159 | 291 | 6 | | | |
| Y(62) EK 3½,2,1 | 2.2 | 1.9 | 0.5 | — | — | (1.4) | " | UCON | " | 156 | 257 | 3 | | | |
| Y(62) EK 4½,2,1 | 2.7 | 1.9 | 0.6 | — | — | (1.7) | " | UCON | " | 169 | 289 | 3 | 131 | 209 | 5 |
| Y(62) EKD 3½,2,1,½ | 2.1 | 1.9 | 0.6 | 0.4 | — | (1.3) | 8 h 535° C. | UCON | " | 162 | 272 | 3½ | 130 | 218 | 12 |
| Y(62) EKD 4½,3½,1,½ | 2.8 | 3.6 | 0.5 | 0.5 | — | (1.7) | 8 h 525° C. | UCON | " | 183 | 254 | 1½ | 154 | 238 | 4 |
| QE 22 | | | | | | | | | | 205 | 266 | 4 | 122 | 160 | 30 |
| QH 21 | | | | | | | | | | 210 | 270 | 4 | 167 | 185 | 16 |
| EQ 21 | | | | | | | | | | 195 | 260 | 4 | 152 | 166 | 15 |
| RR350 | | | | | | | | | | 233 | 258 | 1 | 144 | 185 | 3 |

| DESIGNATION | Tensile Properties (N/mm²) at Temp. Stated 300° C. YS | UTS | E % | 325° C. YS | UTS | E % | 350° C. YS | UTS | E % |
|---|---|---|---|---|---|---|---|---|---|
| YE 5½,3 | 139 | 200 | 7 | | | | | | |
| YE 5½,3 | — | — | — | | | | | | |
| YED 5,2,½ | | | | | | | | | |
| YED 5,3½,½ | | | | | | | | | |

TABLE 5-continued

| | | | | | | | | | |
|---|---|---|---|---|---|---|---|---|---|
| YED 5½,3,½ | 152 | 196 | 6½ | | | | | | |
| YEK 2½,3½,1 | 130 | 168 | 8 | | | | | | |
| YEK 2½,2,1 | | | | | | | | | |
| YEK 3,5,1 | | | | | | | | | |
| YEK 3½,3½,1 | | | | | | | | | |
| YEK 4,1½,1 | 92 | 175 | 17 | | | | | | |
| YEK 4,3,1 | 126 | 174 | 11½ | | | | | | |
| YEK 4,1½,1 | | | | | | | | | |
| YEK 4½,2,1 | | | | | | | | | |
| YEK 5,2,1 | 99 | 182 | 20 | | | | | | |
| YEK 5½,3,1 | — | — | — | | | | | | |
| YEK 6½,1½,1 | 104 | 180 | 13 | | | | | | |
| YEKD 2,4,1,½ | | | | | | | | | |
| YEKD 3½,2,1,½ | 102 | 165 | 16 | | | | | | |
| YEKD 3½,4,1,½ | | | | | | | | | |
| YEKD 4,2,1,½ | | | | | | | | | |
| YEKD 4,3,1,½ | | | | | | | | | |
| YEKD 5½,3½,1,½ | 176 | 218 | 13 | 156 | 182 | 13 | | | |
| YEKD 6,1½,1,½ | 105 | 184 | 15 | | | | | | |
| YEKD 8,3,1,½ | 176 | 242 | 3½ | 161 | 204 | 3 | 131 | 159 | 8½ |
| YEKC 3½,4,1,0 | | | | | | | | | |
| YEKC 4,2,1,0 | | | | | | | | | |
| YEKC 4½,3,1,0 | 117 | 188 | 7½ | | | | | | |
| Y(62) K 8,1 | 109 | 180 | 11 | | | | | | |
| Y(62) EK 2½,2,1 | | | | | | | | | |
| Y(62) EK 3½,2,1 | | | | | | | | | |
| Y(62) EK 3½,2,1 | | | | | | | | | |
| Y(62) EK 4½,2,1 | 106 | 163 | 8 | | | | | | |
| Y(62) EKD 3½,2,1,½ | 113 | 161 | 12 | | | | | | |
| Y(62) EKD 4½,3½,1,½ | | | | | | | | | |
| QE 22 | 70 | 80 | 62 | | | | | | |
| QH 21 | 120 | 131 | 19 | | | | | | |
| EQ 21 | 115 | 128 | 10 | | | | | | |
| RR350 | 113 | 151 | 4½ | | | | 83 | 114 | 6½ |

TABLE 6

| DESIGNATION | ANALYSIS % Y | Nd | Zr | Cd | HRE | TIME TO 0.2% CREEP STRAIN (HRS)(1) |
|---|---|---|---|---|---|---|
| YE 3½,5 | 3.7 | 5.0 | — | — | — | 954 |
| YE 5½,3 | 5.5 | 2.8 | — | — | — | 1850 |
| YEK 3½,5,1 | 3.7 | 5.0 | 0.5 | — | — | 27 |
| YEK 4,1½,1 | 3.8 | 1.7 | 0.6 | — | — | 204 |
| YEK 4,3,1 | 3.8 | 2.8 | 0.6 | — | — | 155 |
| YEK 5,2,1 | 5.0 | 1.8 | 0.6 | — | — | 170 |
| YEK 6½,1½,1 | 6.3 | 1.5 | 0.6 | — | — | 59 |
| YEK 6½,3,1 | 6.4 | 3.0 | 0.5 | — | — | 152 |
| YEKD 3½,4,1,½ | 3.4 | 4.0 | 0.4 | 0.4 | — | 44 |
| YEKD 6,1½,1,½ | 6.0 | 1.5 | 0.6 | 0.5 | — | 17 |
| YEKD 8,3,1,½ | 8.1 | 3.1 | 0.6 | 0.5 | — | 120 |
| Y (62) K 8,1 | 5.0 | — | 0.5 | — | (3.0) | 124 |
| Y (62) EK 4½,2,1 | 2.7 | 1.9 | 0.6 | — | (1.7) | 78 |
| Y (75) EK 8½,2½,1 | 6.5 | 2.4 | 0.5 | — | (2.2) | 132 |
| Y (62) EKD 3½,2,1,½ | 2.1 | 1.9 | 0.6 | 0.4 | (1.3) | 79 |
| ZT1 | M.E.L.DATA (typical) | | | | | 100 |
| RR350 | R.R.DATA (typical) | | | | | 3000 |

TABLE 8

| ALLOY | SPIRAL LENGTH (cm) AT 780° C. |
|---|---|
| ZE63 | 80 |
| AZ91 | 100 |
| QE 22 | 69 |
| YEK 5½,3,1 | 94 |

TABLE 9

| ALLOY | PLATE D[1] AA[2] | PLATE D[1] MR[3] | PLATE E AA | PLATE E MR | PLATE F AA | PLATE F MR |
|---|---|---|---|---|---|---|
| QE 22 | 50 | 7 | 80 | 4 | 50 | 7 |
| YEK 5½,3,1 | 50 | 5 | 20 | 2 | 50 | 6 |

TABLE 10

| ALLOY | AVERAGE CORROSION RATE IMMERSION | RAE TEST |
|---|---|---|
| YEK 5,1,1 | 0.6 | 0.7 |
| YEK 5½,1½,1 | 0.6 | 0.7 |
| RZ5 | 1 | 1 |
| QE 22 | 2.6 | 9 |

TABLE 7

| DESIGNATION | Analysis % Y | Nd | Zr | Type of Test Bar | Heat Treatment Solution | Quench | Age | R.T. Tensile Properties (N/mm²) Y.S. | U.T.S. |
|---|---|---|---|---|---|---|---|---|---|
| YEK 5½,3,1 | 5.3 | 3.2 | 0.45 | HF | 8 h 517° C. | H.W.Q. | 20 h 200° C. | 200 | 315 |
| | | | | | " | " | 35 h 200° C. | 205 | 310 |
| | | | | | " | " | 144 h 200° C. | 232 | 312 |
| | | | | DTD | 8 h 517° C. | H.W.Q. | 20 h 200° C. | 216 | 298 |
| | | | | | " | " | 144 h 200° C. | 229 | 293 |
| YEK 5½,3,1 | 5.68 | 2.92 | 0.56 | HF | AS CAST | | — | 146 | 230 |
| | | | | | AS CAST | | 20 h 200° C. | 174 | 262 |
| | | | | | 8 h 535° C. | H.W.Q. | 20 h 200° C. | 208 | 340 |
| | | | | DTD | AS CAST | | 20 h 200° C. | 191 | 236 |
| | | | | | 8 h 535° C. | H.W.Q. | 20 h 200° C. | 209 | 316 |

We claim:

1. A magnesium alloy consisting of, apart from normal impurities, (a) from 1.5 to 10% by weight of an yttrium component consisting of at least 60% by weight of yttrium and the balance, if any, of heavy rare earth metals, and (b) from 1 to 6% by weight of a neodymium component consisting of at least 60% by weight of neodymium, not more than 25% by weight of lanthanum and substantially all the balance, if any, of praseodymium, the remainder of the alloy consisting of magnesium.

2. An alloy according to claim 1, in which the total content of yttrium component and neodymium component is from 4 to 14%.

3. An alloy according to claim 1, which contains from 2.5 to 7% of yttrium component and 1.5 to 4% of neodymium component, the total content of yttrium component and neodymium component being from 6 to 8.5%.

4. An alloy according to claim 1, which contains from 3.5 to 9% of yttrium component and from 2.5 to 5% of neodymium component, the total content of yttrium and neodymium components being from 7.5 to 11.5%.

5. An alloy according to claim 1, which contains from 3.5 to 8% of yttrium component and from 2 to 3.5% neodymium component, the total content of yttrium component and neodymium component being from 7 to 10%.

6. An alloy according to claim 1, in which the yttrium component contains at least 75% by weight of yttrium.

7. An alloy according to claim 1, which also contains up to 1% by weight of zirconium.

8. An alloy according to claim 1, which also contains up to 1% by weight of cadmium.

9. An alloy according to claim 1, which also contains up to 0.15% by weight of copper or up to 1% by weight of silver.

10. An alloy according to claim 1, which further contains one or more of the following constituents by weight:

Thorium—0–1%
Lithium—0–6%
Gallium—0–2%
Indium—0–2%
Thallium—0–5%
Lead—0–1%
Bismuth—0–1%
Manganese—0–2%.

11. An alloy according to claim 1, containing from 1.5 to 9% of the yttrium component and in which the yttrium component contains at least 62% of yttrium.

12. An article obtained by casting a magnesium alloy according to claim 1.

13. An article according to claim 12, in which the article has been subjected to solution heat treatment, quenching and ageing at an elevated temperature.

14. An article according to claim 13, in which the solution heat treatment is carried out at a temperature of about 20° C. below the solidus temperature for about 8 hours, quenching is carried out in water or a solution of a quench moderating agent and ageing is carried out at a temperature of about 200° C.

15. An article according to claim 13 or 14, in which the article is aged for about 20 hours.

16. An article according to claim 13 or 14, in which the article is aged for up to 144 hours.

17. An article according to claim 13, which has been aged at an elevated temperature without solution heat treatment or quenching.

* * * * *